US007604720B2

(12) United States Patent
Kaczur et al.

(10) Patent No.: US 7,604,720 B2
(45) Date of Patent: Oct. 20, 2009

(54) PROCESS FOR THE ON-SITE PRODUCTION OF CHLORINE AND HIGH STRENGTH SODIUM HYPOCHLORITE

(75) Inventors: Jerry J. Kaczur, North Miami Beach, FL (US); Derek B. Lubie, North Miami Beach, FL (US); Edmund M. Cudworth, Miami, FL (US); Charles W. Clements, Crawfordsville, FL (US); Martin E. Nelson, Naples, FL (US)

(73) Assignee: Electrolytic Technologies Corp., North Miami Beach, FL (US)

( * ) Notice: Subject to any disclaimer, the term of this patent is extended or adjusted under 35 U.S.C. 154(b) by 7 days.

(21) Appl. No.: 11/741,004

(22) Filed: Apr. 27, 2007

(65) Prior Publication Data

US 2007/0251831 A1 Nov. 1, 2007

Related U.S. Application Data

(60) Provisional application No. 60/796,917, filed on Apr. 29, 2006.

(51) Int. Cl.
*C25B 9/18* (2006.01)
*C01B 11/06* (2006.01)
*C25B 1/26* (2006.01)

(52) U.S. Cl. ..... 204/258; 422/235; 423/473; 205/500; 204/233; 204/241

(58) Field of Classification Search ..... 423/473
See application file for complete search history.

(56) References Cited

U.S. PATENT DOCUMENTS 1,403,993 A * 1/1922 Wallace et al. ..... 423/473
1,414,059 A * 4/1922 La Fayette ..... 423/473
3,582,262 A * 6/1971 Tomany ..... 423/240 R
3,925,174 A * 12/1975 Eng et al. ..... 205/500
3,933,631 A * 1/1976 Adams ..... 210/677
4,060,465 A * 11/1977 Yokota et al. ..... 205/618
4,198,277 A * 4/1980 Kurtz et al. ..... 205/347
4,204,920 A * 5/1980 Kurtz et al. ..... 205/516

(Continued)

FOREIGN PATENT DOCUMENTS

JP 59102806 A * 6/1984

OTHER PUBLICATIONS

Full English translation of JP 59-102806 A.*

*Primary Examiner*—Harry D Wilkins, III
(74) *Attorney, Agent, or Firm*—Feldman Gale PA

(57) ABSTRACT

The present invention relates to a novel economical on-site electrochemical based membrane cell based process with the capability of producing high strength sodium hypochlorite and/or elemental chlorine gas in any ratio as required by the needs of a water or wastewater treatment plant. The system is compact and modular, using membrane cell based electrolyzers and utilizing novel process modifications and sensors to allow for the unattended control and safe operation of the process. The process allows the operator to produce elemental chlorine gas and sodium hypochlorite in any product ratio, such that 5% to 100% of the total chlorine produced by the process can be converted to high strength bleach. The process has the flexibility to produce stable high quality, low to high strength sodium hypochlorite solutions in concentrations ranging from about 2 to 15% trade as NaOCl.

12 Claims, 3 Drawing Sheets

U.S. PATENT DOCUMENTS 4,242,185 A * 12/1980 McRae ..... 205/536
4,267,026 A * 5/1981 Patel ..... 205/536
4,285,786 A * 8/1981 Larson ..... 205/335
4,308,123 A * 12/1981 Lynn ..... 204/266
4,330,521 A * 5/1982 Glineur ..... 423/473
4,405,418 A * 9/1983 Takemura ..... 205/345
4,532,018 A 7/1985 Wright et al.
4,744,956 A * 5/1988 Yant et al. ..... 422/106
4,892,636 A 1/1990 Bolick, II et al.
4,981,563 A * 1/1991 Spaziante et al. ..... 205/348
5,084,148 A 1/1992 Kazcur et al.
5,084,149 A 1/1992 Kaczur et al.
5,164,080 A * 11/1992 Furuno ..... 210/195.1
5,264,089 A 11/1993 Kaczur et al.
5,270,019 A * 12/1993 Melton et al. ..... 422/234
5,616,234 A * 4/1997 Rhees et al. ..... 205/500
5,679,239 A * 10/1997 Blum et al. ..... 205/556
2003/0066758 A1 * 4/2003 Bess et al. ..... 205/556

* cited by examiner

PROCESS FOR THE ON-SITE PRODUCTION OF CHLORINE AND HIGH STRENGTH SODIUM HYPOCHLORITE

CROSS-REFERENCE TO RELATED APPLICATIONS

The present application claims priority benefit under 35 U.S.C. §119(e) of U.S. Provisional Patent Application Ser. No. 60/796,917 filed Apr. 29, 2006. The disclosure of this application is incorporated herein by reference.

FIELD OF THE INVENTION

The present invention relates generally to a process for the electrochemical generation of elemental chlorine and sodium hydroxide using sodium chloride as a feedstock, specifically utilizing membrane cell based technology. The invention further relates generally to the electrochemical generation of high strength sodium hypochlorite or bleach from these products, which can be used, for example, in potable water and wastewater plants for disinfection and oxidation.

BACKGROUND OF THE INVENTION

Commercial chlor-alkali membrane cell based installations are efficient in producing elemental chlorine and sodium hydroxide and co-products, such as hydrogen and sodium hypochlorite for commercial sale. However, the transportation and storage of liquid elemental chlorine shipped via tank cars or in one ton cylinders to the point of use at customer sites is increasingly becoming a public safety concern. Rail transportation accidents have occurred in populated areas resulting in the unintentional and sometimes fatal release of the pressurized elemental chlorine gas. In addition, the on-site storage of pressurized elemental chlorine liquid/gas requires costly modifications to facilities to insure secure access and to install caustic scrubbers specifically designed to neutralize unintentional chlorine gas releases. Water and wastewater treatment plants have been converting to the use of sodium hypochlorite, a safer alternative to pressurized elemental chlorine. Bulk delivery and storage of high strength sodium hypochlorite, as well as on-site generation of sodium hypochlorite from salt is increasingly becoming the standard practice for water utilities.

Commercial high strength sodium hypochlorite is typically delivered in a concentration range of 10% to 15% trade to reduce the costs of shipping and handling. In the past 15 years, technology improvements and process economics have evolved to a point where on-site electrochemical generation of high strength sodium hypochlorite is an economically viable alternative to pressurized elemental chlorine and commercially supplied bulk quantities of high strength sodium hypochlorite. In these smaller packaged systems, sodium chloride becomes the primary raw material delivered to the site where it is converted to a sodium hypochlorite solution product.

One of the on-site electrochemical sodium hypochlorite technologies that is presently available generates a 0.8 wt % sodium hypochlorite product solution using a dilute sodium chloride feed solution and an electrochemical cell design that incorporates no separator between the electrolyzer anode and cathode electrodes. The reaction products from the electrodes are allowed to mix together to produce a weak sodium hypochlorite product solution. In this type of system, only 20-30% of the salt in the sodium chloride feed solution is converted to sodium hypochlorite, with the unreacted salt remaining in the sodium hypochlorite solution product. A significant deficiency associated with this technology is the quantity of storage required for the dilute solution product (as compared with high strength sodium hypochlorite) as well as the high salt content of the sodium hypochlorite solution product.

In view of the above, it would be beneficial to develop a system that (a) eliminates the need for transporting liquid elemental chlorine, (b) reduces the need for large sodium hypochlorite storage capacities, and (c) reduces, if not eliminates, the addition of any unreacted feedstock salt into the sodium hypochlorite product.

BRIEF SUMMARY OF THE INVENTION

The present invention provides a novel electrochemical membrane cell based process capable of providing a variable ratio of chlorine gas to sodium hypochlorite (e.g., high strength sodium hypochlorite solution) as required by the process needs of the user.

The present invention also provides a novel electrochemical generating system that is compact, modular in construction, uses membrane cell based electrolyzers, and utilizes process features and sensors to allow for the control and operation of the process.

DETAILED DESCRIPTION OF THE INVENTION

Figure 1:
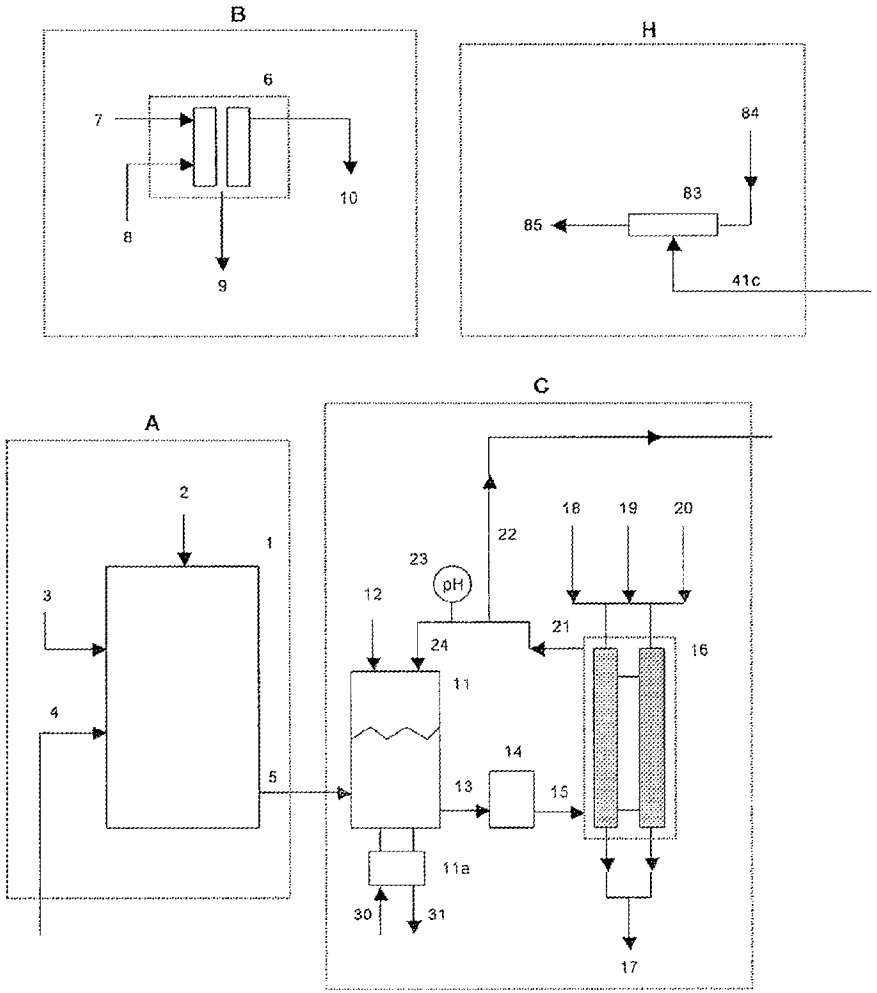
FIG. 1 shows a process flowsheet of an example of modules A, B, C, and H of the present invention.

The alternative on-site electrochemical sodium hypochlorite technology embodied in the present invention is based on chlor-alkali membrane cell technology which produces elemental chlorine gas at or below one atmosphere and very pure sodium hydroxide as two co-products that can be reacted together to produce a high strength or concentrated sodium hypochlorite product. This type of technology, while considered state-of-the-art technology in newer large scale chlor-alkali plants, has not previously been developed for on-site (e.g., small scale). In order to commercialize this technology effectively for on-site generation of sodium hypochlorite, the process must be in a compact, economically manufactured machine with automated controls designed for unattended operation and be sufficiently efficient and versatile in its generation of solution products to be economical to operate. The advantage of the present invention and the generating system it employs is that it can produce high strength sodium hypochlorite at or in close proximity to the point of use, which is identical if not better in quality to commercially supplied bulk sodium hypochlorite products. In addition, it requires less on-site solution storage when compared to the storage requirements of dilute sodium hypochlorite solutions and it is free (i.e., 0%) of any salt from the feed brine that is typically present in the dilute 0.8% sodium hypochlorite solution products.

In an embodiment, the present invention provides a novel electrochemical generating system, comprising: four interlinked process modules, comprising: (a) a briner module (e.g., where high purity sodium chloride is dissolved to make a concentrated brine solution); (b) a brine softener unit (e.g., where hardness from the saturated sodium chloride brine solution is efficiently reduced by chelating ion exchange resins (e.g., to less than 80 ppb total hardness calculated as calcium)); (c) an electrolyzer module (e.g., where the sodium chloride brine is electrolyzed using membrane based electrolyzer cells to produce chlorine gas and a sodium hydroxide solution co-product and diluting the co-product hydrogen safely with air); and (d) a sodium hypochlorite conversion unit (e.g., wherein the elemental chlorine gas produced can be reacted with the sodium hydroxide solution to produce sodium hypochlorite (i.e., bleach) at varying concentrations).

In another embodiment, the present invention allows the user to convert from 1-100% of the produced elemental chlorine gas into a sodium hypochlorite product solution in concentrations ranging from about 2-15% trade NaOCl.

In another embodiment, the present invention allows for the conversion of feed brine NaCl to chlorine and NaOCl in the amounts including (a) at least 90, 91, 92, 93, 94, 95, 96, 97, or 98%, and (b) at least 95%.

The present invention utilizes a number of features that help achieve a novel electrochemical process that is compact, economical, safe, and sufficiently versatile to meet the requirements for on-site generation of elemental chlorine gas and sodium hypochlorite that can be used, for example, for potable and municipal waste water treatment. Some of these features include:

a. Providing a method for dissolving solid sodium chloride salt to produce a saturated brine that employs softened (or deionized) water for dissolving the salt;
b. Providing a method for softening the saturated brine, which is fed to the electrolyzers, such that the brine softening subsystem can be compact, fully automated, economic, and reliable to operate and does not require the use of a large finished purified brine storage tank;
c. Providing a method of using the operating current of the electrolyzer with a conductivity sensor to control the addition of saturated brine feed to the anolyte compartment of the membrane cell electrolyzers to enable the electrolyzer(s) to maintain the proper sodium chloride concentration for optimum operation;
d. Providing a method for dechlorinating the depleted brine the employs sodium bisulfite by employing an ORP (oxidation reduction potential) sensor to optimize chemical consumption and ensure that the dechlorination is completed;
e. Providing a method for dilution of the hydrogen gas that is co-produced in the electrolytic process, with sufficient air to insure fail-safe system operation;
f. Providing a method that employs eductors in combination with orifices and control of chlorine pressure, for producing elemental chlorine gas and sodium hypochlorite in a controllable product ratio such that 1-100% of the total chlorine produced by the process can be converted to a sodium hypochlorite product (e.g., high strength NaOCl solution); and,
g. Providing a method for isolating individual electrolyzers on the electrolyzer module such that the selected electrolyzer can be quickly electrically and hydraulically isolated and if necessary, removed from the system, thus allowing continued operation of the system with the remaining electrolyzers.

On site refers to systems capable of producing from 20 lbs/day to 60 tons of chlorine equivalent per day, including 50, 100, 500, and 1000 lbs/day, and 1, 2, 5, 10, 20, 30, 40, and 50 tons/day (as compared with industrial scale production, which is typically on the order of 100-200 tons per day).

High strength NaOCl solution or high strength NaOCl refers to 5-15% trade NaOCl. By definition, 15% trade sodium hypochlorite contains 150 gm/L NaOCl, and a 5% trade NaOCl contains 50 gm/L NaOCl. Low strength NaOCl solution or low strength NaOCl refers to 0.5 to 1% trade NaOCl.

Figure 2:
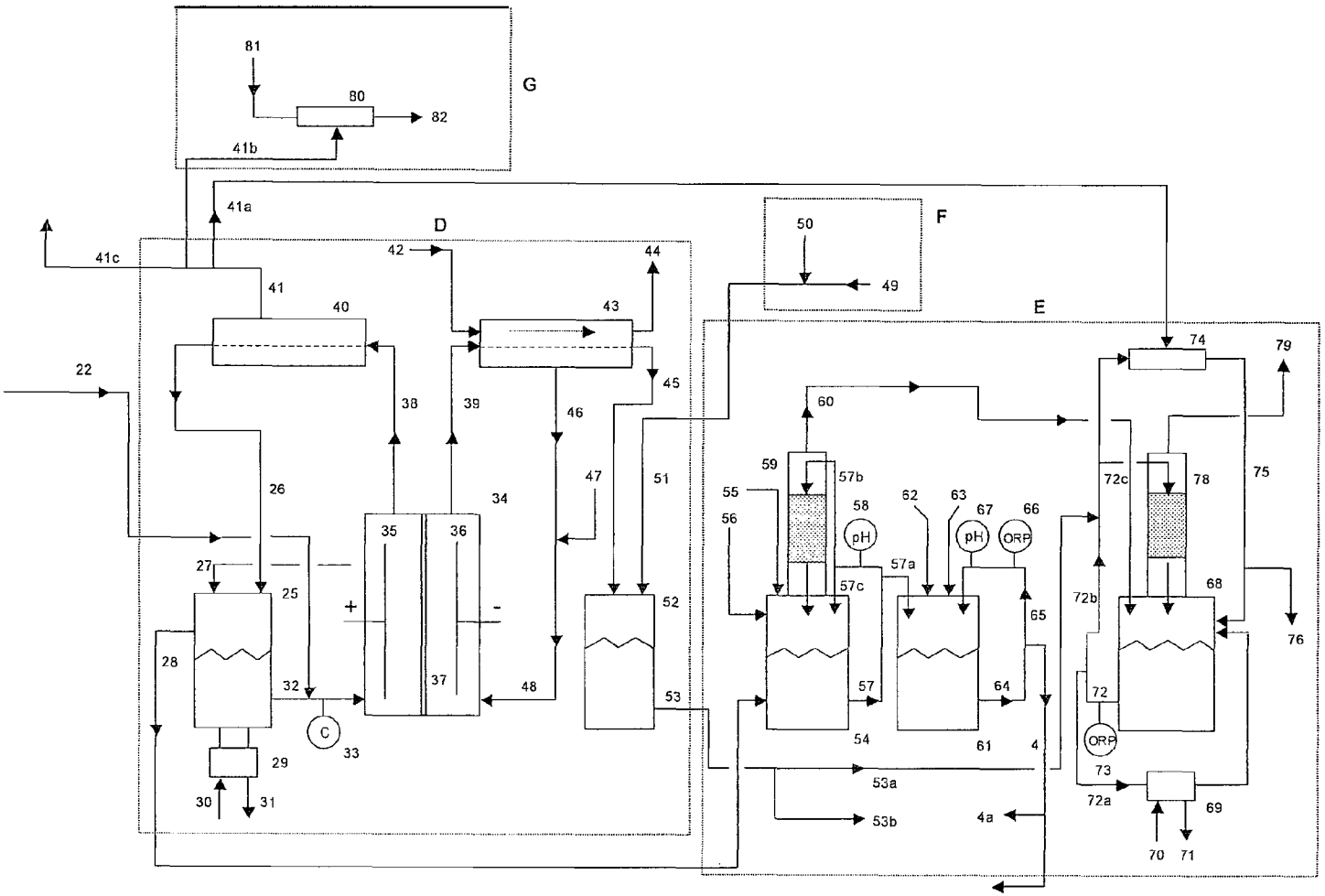
FIG. 2 shows a process flowsheet of an example of modules D, E, F, and G of the present invention.
Figure 3:
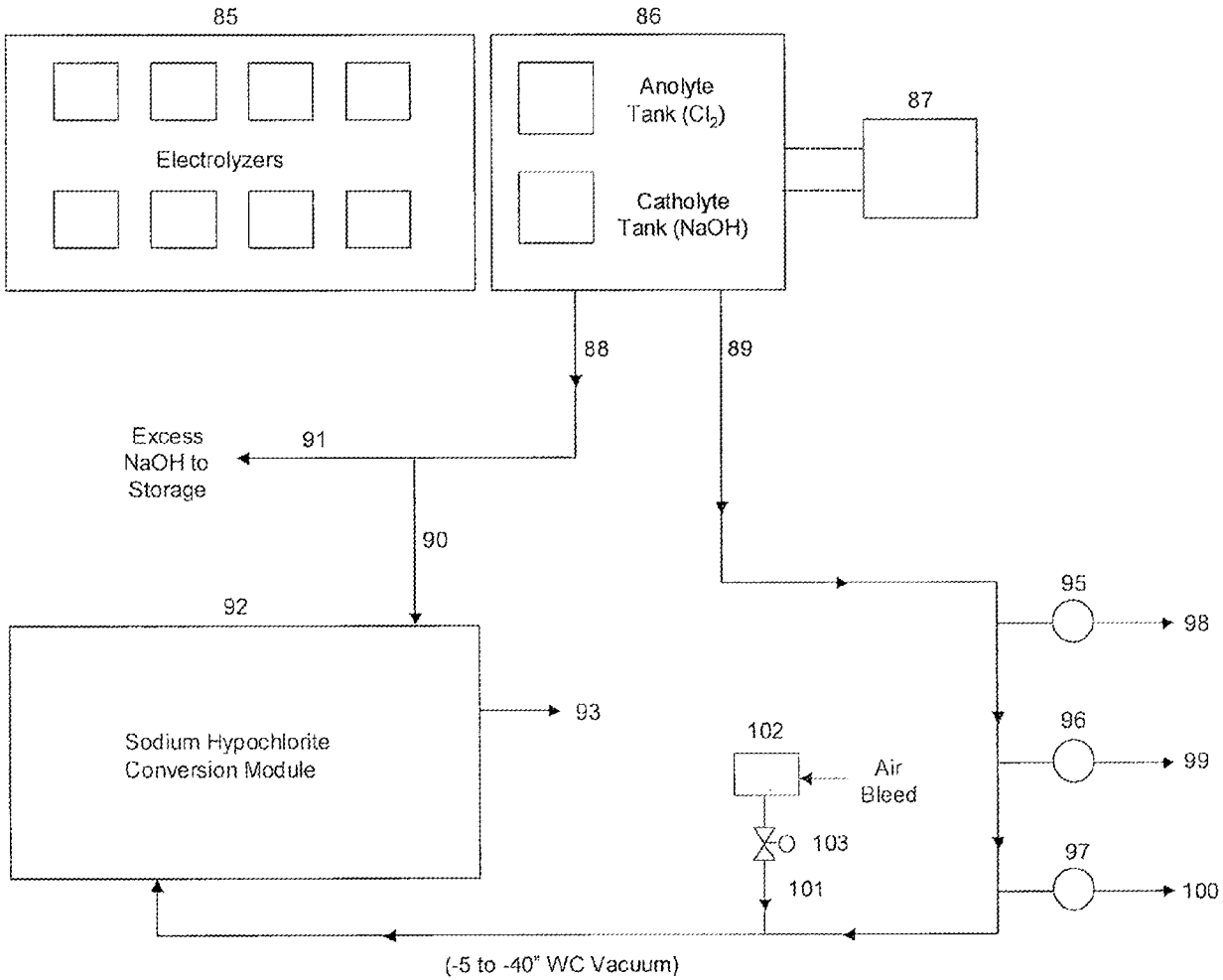
FIG. 3 shows a process flowsheet of an example of the present invention having multiple chlorine gas application points.

FIGS. 1 and 2 provide a schematic illustration of an example of the present invention. FIG. 3 shows an example of the present invention showing the distribution of chlorine from the electrolyzer to various application points as well as co-currently producing sodium hypochlorite as needed.

In process module A, a saturated brine solution feedstock is produced for the process. Sodium chloride salt 2 is added to briner tank 1 and softened (or deionized) water 3 is used to dissolve the salt to produce saturated brine solution 5. Depleted brine solution 4 from depleted brine tank 61 is recycled back to briner tank 1 for salt resaturation. Stream 4*a* is a small brine purge stream used to control the concentration of sodium chlorate in the brine system.

In membrane cell chlor-alkali processes, the anolyte brine solution circuit accumulates sodium chlorate, which is formed from the back migration of NaOH into the anolyte, forming HOCl. A portion of the HOCl chemically disproportionates into sodium chlorate and NaCl under the anolyte solution circuit process conditions. This brine purge containing chlorate can be sent to a separate process module (not shown), where the chlorate can be decomposed into chlorine and NaCl under low pH conditions (e.g., 1-3 M HCl) and at high temperatures (e.g., 60-90° C.). The resultant solution can be adjusted to pH 10 with NaOH and recycled back to the briner for resaturation. This provides a method of recovering the economic value of the salt as well as additional chlorine from this purge stream which is otherwise lost from the process.

In process module B, softened water is produced for the process. Alternatively, deionized water can also be used. A commercially available alternating two column water softener 6 uses a pressurized potable water source 7, which is passed through the cation ion exchange resin beds to produce low hardness water 10, with total hardness levels (total calculated as calcium) below 0.2 ppm (e.g., 0.1, 0.05, 0.01 ppm or lower). Brine solution stream 8 (which can use a portion of saturated brine solution 5) is used to periodically regenerate the water softener resin columns, producing effluent stream 9 which consists of the salt solution and water flush sequences used in the regeneration.

In process module C, a unique method of softening saturated brine solution 5 is used, removing total hardness (calcium and magnesium) in the Final brine solution to a concentration of less than 80 ppb calculated as calcium. The hardness in the brine solution can be further reduced to 60, 40, 20 or less ppb as required. Saturated brine solution 5 is pumped on level control into brine recirculation tank 11. Heat exchanger 11*a* captures heat from heat exchanger 29 to heat the brine after the system comes up to operating temperature.

A pump (not shown) circulates brine solution 13 from the brine recirculation tank through electric brine heater 14, and the heated brine stream 15 enters the two column ion exchange system 16, which uses commercially available chelating ion exchange resins designed to remove hardness from brine solutions. The purified brine solution exits the columns as stream 21 and is split into stream 22, which goes to the electrolyzer module in Process Module D to produce chlorine, and stream 24, which reenters the brine recirculation tank 11. pH sensor/controller 23 is used to control the addition of sodium hydroxide solution 12 into the brine solution in tank 11 to maintain brine pH at an optimum range between 9 and 11 pH for optimum chelating ion exchange resin performance. Brine heater 14 and heat exchanger 11*a* are controlled to heat the brine to an optimum temperature operating range for obtaining optimum chelating ion exchange resin performance. Chelating resin columns 16 are periodically regenerated per the resin manufacturer recommendations using softened water 18 for rinses and backwashes, and using 32% HCl solution 19 and 15% NaOH solution 20 in a set sequence for removing the accumulated hardness and impurities collected from the brine and converting the resin back into its regenerated form.

In process module D, a set of membrane cell electrolyzer(s) 34 (typically a plurality thereof) converts softened brine stream 22 into chlorine, sodium hydroxide, and hydrogen. Softened brine stream 22 is fed into circulation stream 32, which goes into an anolyte solution header (not shown) which distributes brine into the anolyte compartments of one or more electrolyzer(s) 34. Solution conductivity sensor 33 is used to monitor and/or control the anolyte solution brine concentration. The flowrate of saturated brine stream 22 is dependent on the amperage selected for the electrolyzer and the operating brine concentration of the electrolyzer anolyte. The electrolyzer(s) comprises at least one (typically a plurality) individual membrane cell, comprising cation ion exchange membrane 37, which separates the cell into anolyte compartment 35 containing an anode from catholyte compartment 36 containing a cathode. As amperage to electrolyzer(s) 34 is applied, the formation of chlorine gas in anolyte compartment 35 and formation of hydrogen gas in catholyte compartment 36 generate gas lift, which produce solution circulation through the corresponding cell compartments.

During electrolyzer(s) 34 operation, brine solution 32 flows through anolyte compartment 35, generating chlorine gas/brine solution mixture 38 which is disengaged in chlorine head tank or header 40 into a separate gas and liquid brine solution stream. The brine solution that had passed through anolyte compartment 35 is partially depleted of NaCl, and circulates back into anolyte tank 25. Anolyte tank 25 has heat exchanger 29 to provide cooling for the anolyte brine system as required by the process design with inlet cooling water stream 30 and outlet cooling water stream 31. Additionally (not shown), a heating coil (e.g., titanium or fluoropolymer) can be placed in anolyte tank 25 to transfer heat from anolyte brine to the brine in solution tank 11 using heat exchanger 11*a* so that brine heater 14 is essentially only on during the initial cold process startup. This can be done by taking a portion of recirculating brine stream 21 through the heating coil and passing the heated brine solution back into heat exchanger 11*a*.

Also during electrolyzer(s) 34 operation, sodium hydroxide solution 48 flows through catholyte compartment 36, generating hydrogen gas/NaOH solution mixture 39, which is disengaged in sodium hydroxide head tank or header 43 into hydrogen gas and a concentrated sodium hydroxide solution stream. Sodium hydroxide stream 46 is recirculated back to electrolyzer(s) 34. Softened water stream 47 is added to sodium hydroxide stream 46 to dilute the NaOH and maintain the required NaOH concentration for the process (e.g., 15 wt % as NaOH when using lower performance cation ion exchange membranes in the electrolyzers). Sodium hydroxide stream 45 is the overflow NaOH product stream that is produced in the catholyte system and flows into sodium hydroxide receiver storage tank 52. Sodium hydroxide stream 53 is split into two streams 53*a*, which goes to the sodium hypochlorite module and 53*b*, which goes to where caustic is required in the system for pH control (e.g., streams 62 and 12). When the present process is converting a high percentage of the generated chlorine gas (e.g., 95-100%) to sodium hypochlorite, there typically is not sufficient NaOH product solution produced to generate a stable sodium hypochlorite solution and for brine pH control.

Module F is utilized to produce the additional required NaOH solution volume at a specified concentration by metering commercially available high strength NaOH 49 (e.g., 20, 25, 40, to 50 wt % NaOH) that is diluted with softened water stream 50 in the correct proportions to produce NaOH makeup stream 51, which is used to keep sodium hydroxide storage tank 52 full on level control. The strength of NaOH delivered to the NaOH storage tank depends upon the strength in the tank, which is the concentration strength chosen to be used in the system.

The present invention allows for the use of a unique hydrogen dilution system where air stream (using a blower) 42 is used to immediately dilute hydrogen gas generated in electrolyzers(s) 34 and present in mixed gas/solution stream 39 as it is disengaged in sodium hydroxide header 43. The hydrogen is diluted to well below the LEL (Lower Explosive Limit) of hydrogen in air (which is approximately 4% by volume) to ensure safe operation of the electrolyzers. The dilute hydrogen in air stream 44 is safely vented to the atmosphere. Alternatively, the hydrogen gas can be taken off without air dilution, and be removed from the system to a compression unit where the hydrogen gas can be utilized as a fuel (e.g., burned), stored (e.g., cooled to produce liquid hydrogen), or reacted with chlorine to form HCl.

In process module E, the depleted brine stream from the electrolyzer(s) is dechlorinated and pH adjusted for recycling back to the briner tank, and chlorine is reacted with the co-produced sodium hydroxide to produce sodium hypochlorite (e.g., high strength NaOCl).

Depleted brine stream 28 from anolyte tank 25 contains dissolved chlorine that must be removed before it can be recycled back to briner 1 for resaturation. Depleted brine stream 28 is passed into chlorine stripper tank 54 where concentrated HCl solution 55 is added to the brine using pH sensor/controller 58 to reduce the solution pH down to a value of about 2 so that the dissolved chlorine can be easily stripped from the solution. Acidified solution stream 57 from tank 54 is circulated by pump (not shown) and splits into solution stream 57*c* that returns back into the tank to promote mixing, stream 57*b* that goes into chlorine stripping tower 59 that contains high efficiency column packing and stream 57*a*, which is removed from tank 54 on level control into depleted brine tank 61. Blower air stream 56 is used to pass air through stripper column 59 to strip chlorine from solution stream 57*b*, and chlorine in air stream 60 is passed into sodium hypochlorite conversion tank 68 for safely converting the stripped chlorine into sodium hypochlorite.

Depleted brine solution stream 57*a*, which is acidic and contains a small amount of residual chlorine, enters depleted brine tank 61 where the solution pH is raised to about pH 10 with the addition of NaOH solution stream 62, which is controlled by pH sensor/controller 67. A pump (not shown) is used to circulate depleted brine solution 64, which is split into stream 65, which provides circulation back into tank 61, and solution stream 4 which removes the pH adjusted and dechlorinated depleted brine from tank 61 on level control to briner tank 1. ORP sensor/controller 66 is used to control the addition of sodium bisulfite stream 63 to ensure that the brine is properly dechlorinated before it is recycled to briner tank 1.

Sodium hypochlorite conversion tank 68 consists of a pump (not shown) that circulates alkaline sodium hypochlorite stream 72 that is split into three streams. Flow stream 72*b* goes through eductor 74 to provide the vacuum that pulls chlorine gas stream 41*a* from electrolyzer chlorine header 40, and the eductor output solution stream 75 is returned back to tank 68. Stream 72*c* is a small solution stream that is passed into chlorine absorption tower 78 to remove any residual chlorine from leaving tower vent 79. Sodium hydroxide stream 53*a* is pumped (pump not shown) into sodium hypochlorite stream 72*b* to convert the chlorine to NaOCl and maintain the proper residual sodium hydroxide concentration in the sodium hypochlorite solution product. The flow rate of sodium hydroxide stream 53*a* is controlled by sodium hypochlorite ORP sensors 73 that produce a mV signal proportional to the sodium hydroxide concentration in the sodium hypochlorite solution. Flow stream 72*a* is passed through heat exchanger 69 to cool the sodium hypochlorite solution to maintain sodium hypochlorite stability using cooling water inlet 70 and cooling water outlet 71. The sodium hypochlorite product is drawn off periodically as product stream 76 from a solenoid valve opening (not shown) on level control in sodium hypochlorite tank 68.

In process module G, emergency water supply 81 is used to provide the water flow for emergency eductor 80 to provide the vacuum required to pull chlorine from the system via 41*b* when the chlorine system negative pressure or vacuum is lost, such as when power to the entire system is lost, or the vacuum pull from the sodium hypochlorite eductor 74 is not operating. The residual chlorine in the system exits in eductor stream 82.

Process module H (shown in FIG. 1) provides the flexibility of pulling chlorine from the system via stream 41*c* in any proportion, from 1-99% (e.g., 1, 2, 3, 4, 5, 10, 20, 30, 40, 50, 60, 70, 80, and 90), of the total system chlorine production, such that the ratio of the production or usage of sodium hypochlorite to chlorine can be easily adjusted to meet the process needs of the customer. In the configuration as shown, eductor 83 operates using water flow 84 to provide the motive force to produce the vacuum to pull chlorine from chlorine header 40 via stream 41*c*. The control of the relative flow streams of chlorine via lines 41*a* and 43*c* can be accomplished by in a number of ways. For example one can use proportional control valves and orifices or vacuum pressure controllers, which can control the relative mass flow of chlorine in whatever proportion desired for use as chlorine gas or for the production of sodium hypochlorite.

In FIG. 3 is shown an example of the present invention wherein the system can provide chlorine gas to one or more application points that the customer requires, in addition to producing a proportion as sodium hypochlorite as needed by the customer. Chlorine and sodium hydroxide are produced in electrolyzer module 85 with the anolyte and NaOH storage tank located on receiver module 86. Rectifier 87 provides the DC current in operating the electrolyzers. A 15% NaOH stream 88 from receiver module 86 is split into stream 90 which provides the NaOH required for converting chlorine into sodium hypochlorite in sodium hypochlorite conversion module 92 and stream 91 where the excess NaOH produced from the process is sent to storage for other uses, such a the pH adjustment of water in municipal drinking water plants. Stream 93 is the sodium hypochlorite product from sodium hypochlorite conversion module 92 which is sent to storage.

Stream 89 is the gaseous, wet chlorine gas stream produced from the electrolyzer module 85 and taken off from the anolyte tank on receiver module 86. The chlorine gas is drawn off at one or more chlorine process application points, shown as 98, 99, and 100, which are drawn through chlorine flow controllers 95, 96, and 97 respectively. Each of the application points has a chlorine sensor to determine the amount of chlorine required for each application point.

The entire chlorine gas system is operated and maintained under a negative pressure of approximately −5 to −40 inches of water column (WC). A chlorine pressure sensor 102 and solenoid 103 is used to control the negative pressure and allows air to bleed into chlorine line 89 through stream 101 so that the negative pressure does not go below the set point of the system, such as below −40 inches of pressure (e.g. −50, −60 inches WC). An eductor in sodium hypochlorite module 92 provides the vacuum for the entire chlorine system and takes the excess chlorine and air that remains in chlorine gas stream 89.

The system control PLC (not shown) computes the required total chlorine for the system with additional excess chlorine as needed to produce sodium hypochlorite for backup when the electrochemical system is not operating to ensure that chlorine (as sodium hypochlorite) is available, such as during power outages or for peak chlorine consumption periods that may exceed the capacity of the generation system.

Brine Saturation Module: One example of a salt useful in the present process is a food grade salt having low total hardness content (e.g., less than 50 ppm as Ca). An example of a suitable salt is Morton Culinox 999® food grade salt without anti-caking agents. The salt is typically available in bags as well as in bulk form and can be delivered in tank trucks equipped with a pneumatic delivery system. Commercially available brine saturator tanks can be used, such as those under the Bryneer® tradename, as manufactured by Plas-Tanks Industries (Hamilton, Ohio) and similar brine saturator tanks from other manufacturers. Softened (or deionized) water is typically used to dissolve the solid NaCl to produce a saturated brine solution, which is suitable as a feedstock to the process brine softening module. Examples of concentrations of the saturated brine solution include (a) 280, 290, 300, 310, to 320 gm/L as NaCl and (b) 310 gm/L as NaCl.

Process Feed Brine Softening Module: The process brine softening subsystem effectively employs a unique constant circulation through the chelating ion exchange resin beds (e.g., two or more beds) instead of the typical single pass (i.e. "once-through") two-column in series brine flow used in much larger commercial systems. When a plurality of beds is present, they can be run in series and/or parallel. Running in parallel allows a column to be isolated from the softening module (e.g., via cutoff valves) and regenerated or perhaps replaced or repaired. This constant flow configuration through the ion exchange columns has several advantages. It facilitates quick heating of the brine and removes the requirement and associated cost for employing a finished brine holding tank for containment of the purified brine solution. The softened brine is thus drawn from an outlet of the ion exchange column as required for supply to the electrolyzers. In this continuous flow method, the brine is constantly being softened as it passes through the columns, thus more of the chelating ion exchange resin capacity is utilized, requiring less frequent regeneration with HCl and NaOH as compared to a single-pass two column in series flow configuration. The brine quality obtained from the feed brine softening process described herein results in a total hardness in the range of 80, 70, 60, 50, 40, 30, 20, or less ppb. The pH of the softened brine can be from 9, 10, to 11. The operating temperature of the feed brine softening module is determined by the chelating resin employed and the manufacturer's recommended operating conditions.

Electrolyzer Components: Any suitable anode may be employed in the anode compartment, including those which are available commercially as DSA® (dimensionally stable anodes). Preferably, an anode is selected which will efficiently generate chlorine gas and minimize byproduct oxygen formation. These anodes include expanded metal, porous or high surface area anodes. As materials of construction for the anodes, platinum group metal oxide coatings of iridium, rhodium or ruthenium, and their alloys with other platinum group or precious metals can be employed on various substrates such as valve metals, such as titanium, tantalum and zirconium. Additionally, precious metals including platinum, gold, palladium, or mixtures or alloys thereof, or thin coatings of such materials on various substrates such titanium, can be used. Commercially available anodes of the precious metal oxide type include those manufactured by Eltech Systems Corporation, such as the EC300 series, and the Siemens Optima RUA series electrodes.

Any suitable cathode may be employed in the cathode compartment, which includes expanded metal, porous, or high surface area cathodes typically used in the chlor-alkali industry. Examples include 316L ASTM grade stainless steel and nickel as cathode materials. Other materials such as other nickel-chromium alloys and carbon can be used.

Cation ion exchange membranes selected as separators between compartments are those that are inert membranes and are substantially impervious to the hydrodynamic flow of the alkali metal chloride solution or the electrolytes and the passage of any gas products produced in the anode or cathode compartments. Cation ion exchange membranes are well-known to contain fixed anionic groups that permit intrusion and exchange of cations and exclude anions from an external source. Generally the resinous membrane or diaphragm has as a matrix, a cross-linked polymer, to which are attached charged radicals such as sulfonic acid end groups and/or mixtures thereof with carboxylic acid end groups. The resins which can be used to produce the membranes include, for example, fluorocarbons, vinyl compounds, polyolefins, hydrocarbons, and copolymers thereof. Preferred are cation ion exchange membranes such as those comprised of fluorocarbon polymers or vinyl compounds such as divinyl benzene having a plurality of pendant sulfonic acid end groups or carboxylic acid end groups or mixtures of sulfonic acid end groups and carboxylic acid end groups. The terms "sulfonic acid end group" and "carboxylic acid end groups" are meant to include salts of sulfonic acid and/or salts of carboxylic acid groups. Suitable cation ion exchange membranes are readily available, being sold commercially, for example, by E.I. DuPont de Nemours & Co., Inc., under the trademark "NAFION", by the Asahi Chemical Company under the trademark "ACIPLEX", by Tokuyama Soda Co., under the trademark "NEOSEPTA", and Asahi Glass Co, Ltd, under the trademark "FLEMION". Among these are perfluorinated sulfonic acid type membranes which are resistant to oxidation and high temperatures such as DuPont NAFION types N117, N324, NX908, NX 910, etc., and other polytetrafluorethylene based membranes with sulfonic acid end groups.

The amount of NaOH present in the electrolyzers is dependent upon the performance level of the selected cation ion exchange membrane. For the lower performance membranes, examples of the amount of NaOH present include (a) 5, 10, 15, to 20 wt % as NaOH and (b) 15 wt % as NaOH with current efficiencies of up to 88%. Higher performance membranes (e.g., DuPont's Nafion® NX908) have two layers for improved membrane efficiency, a sulfonic acid layer and a carboxylic acid layer. For these higher performance membranes, the amount of NaOH present includes 5, 10, 15, 20, 25, 30 to 32 wt % as NaOH with current efficiencies of up to 95%.

Anolyte Brine Concentration Control: Electrolyzer current and brine conductivity are used to monitor and control the quantity of the sodium chloride brine added to the electrolyzer anolyte loop. The anolyte loop comprises a brine solution that circulates through the anolyte compartment of the cells via gas lift generated by chlorine generation. Examples of typical anolyte brine concentration ranges include (a) from 200, 205, 210, 215, 220, 225, 230, 235, to 240 gm/L as NaCl and (b) 200, 205, 210, 215, to 220 gm/L as NaCl. Saturated brine (e.g., 310 gm/L) is fed into the anolyte loop to maintain this concentration while the electrolyzers are in operation. The present process uses the rectifier amperage of the operating electrolyzer(s) to set the saturated brine feed rate to the electrolyzers. A conductivity sensor can be used to monitor the brine conductivity to control the addition of saturated brine to the system if the conductivity drops below the selected operating conductivity setpoints. The conductivity is directly proportional to the NaCl concentration in the brine solution. Brine conductivity in the anolyte loop is generally controlled in the range of 150, 160, 170, 180, 190, to 200 millisiemens (mS). Examples of useful sensors include toroidal sensor conductivity probes and titanium conductivity sensors with the proper constant (K) factor. A useful location for the conductivity sensor is in the anolyte loop to reduce any process lag time.

Depleted Brine Dechlorination Control: The depleted brine from the anolyte loop of the electrolyzer subsystem contains dissolved soluble chlorine species, such as chlorine ($Cl_2$) and hypochlorous acid (HOCl). The proportion of HOCl and chlorine in the brine is dependant on the pH of the solution. The depleted brine is transferred to a chlorine stripper tank. The solution is pH adjusted with HCl to convert the dissolved HOCl to $Cl_2$. Useful examples of pH include (a) 1, 1.1, 1.2, 1.3, 1.4, 1.5, 1.6, 1.7, 1.8, 1.9, 2.0, 2.1, 2.2, 2.3, 2.4, to 2.5 and (b) 2. The dissolved chlorine is then easily stripped from the depleted brine solution using air in a packed bed stripping column. This effectively reduces the chlorine concentration in the depleted brine to 100, 90, 80, 70, 60, 50, 40, 30, 20, to 10 ppm or less. The depleted brine solution is then adjusted to about pH 9, 10, to 11 in a second tank (e.g., depleted brine tank) and sodium bisulfite (as a 38 wt % $NaHSO_3$ solution) is added to complete dechlorination of the depleted brine before it is recycled back to the briner. A small amount of excess sodium bisulfite in the briner (e.g., 10, 20, 30, 40, 50, 60, 70, 80, 90, to 100 ppm) is useful to prevent free chlorine from entering the brine softening unit where it, if it did, would oxidize the chelating ion exchange resins. Earlier experiments with an ORP electrode (e.g., platinum versus silver/silver chloride reference) indicated that chlorine in ppm concentration was detectable in a pH 10 solution of depleted brine at an ORP reading of about 250 mV. The addition of bisulfite further dropped the ORP reading, and this ORP level was found useful as a sensor in the process for bisulfite addition control. Target ORP levels of 30, 40, 50, to 60 mV were found to have about 80 ppm of bisulfite present.

Hydrogen Dilution With Air: The present invention provides a novel method of safely diluting the hydrogen produced from the catholyte loop of the electrolyzers with air by disengaging the hydrogen from the sodium hydroxide in a pipe header, herein called the caustic head tank. Typically, the caustic head tank is half full of catholyte solution through which externally supplied air is passed through the internal air space of the header containing hydrogen at a sufficient flow rate to achieve a 2 volume % in air, or less concentration of hydrogen in the exit stream (e.g., 1.5, 1, 0.5 volume % in air), which is then vented to the atmosphere. The caustic header pipe can be designed with a weir and can have a sufficient pipe diameter to prevent excessive air velocity through the internal air space of the pipe. At least one air blower is used to remove the hydrogen gas. It can be desirable to have two air blowers present in the system; with two blowers, one can be in standby or backup mode and the other blower in constant operation generating sufficient air flow for hydrogen dilution and interlocked with the rectifier that supplies DC current to the electrolyzer module to insure continuous positive ventilation.

Individual Electrolyzer Isolation/Removal: The present system is designed to allow individual electrolyzers to be isolated from the plurality of electrolyzers present in an electrolyzer module. This can be achieved by having valves (e.g., manually operated) fitted in the inlet and outlet piping of each electrolyzer. Closing of these valves allows the selected electrolyzer to be hydraulically isolated and, if desired, physically removed from the system, thus allowing the system to continue operation with the remainder of the electrolyzers and significantly reducing "production downtime".

Sodium Hypochlorite Concentration Control: Sodium hypochlorite is prepared in a sodium hypochlorite conversion tank. As noted above, the present invention is capable of converting from 1, 5, 10, 15, 20, 25, 30, 35, 40, 45, 50, 55, 60, 65, 70, 75, 80, 85, 90, 85, to 100% of the elemental chlorine produced in the electrolyzer to NaOCl. The present invention provides a method for controlling sodium hypochlorite concentration, wherein sodium hypochlorite ORP electrodes and water addition are used to produce a stable sodium hypochlorite solution product having a user controlled concentration. Examples of concentrations obtainable include (a) from 2, 2.5, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, to 15% trade NaOCl and (b) from 5-15% trade NaOCl. Both high strength and lower strength NaOCl can be made directly in the sodium hypochlorite conversion tank (e.g., 5-15% trade), without the requirement for dilution of the high strength sodium hypochlorite product with water in another process step. Lower strength NaOCl solutions are prepared in the system by the measured addition of water into the sodium hypochlorite tank solution based on the production rate. This allows the produced solution to be obtained with the desired residual sodium hydroxide concentration and pH to maintain product stability. The sodium hypochlorite ORP probes (e.g., a pair of silver and platinum electrodes) are used to control the residual NaOH concentration in the sodium hypochlorite solution to obtain a product with the appropriate pH to insure good stability. Examples of ORP signals include (a) 450, 500, 550, 600, to 650 mV and (b) 500-600 mV. Typically, the residual content of NaOH in is in the range of 0.2, 00.3, 0.4, to 0.5 wt %, which provides a pH in the range of 11.5, 11.6, 11.7, 11.8, 11.9, 12, 12.1, 12.2, 12.3, 12.4, 12.5, 12.6, 12.7, 12.8, 12.9, and 13, for sodium hypochlorite product stability. The temperature of the sodium hypochlorite conversion tank is typically kept in the range of 15, 20, 25, 30, to 35° C. The desired pH of the resulting sodium hypochlorite solution depends on the % trade NaOCl produced. For 10-15% trade NaOCl, the pH is typically 12-13.5. For 5 to less than 10% trade NaOCl, the pH is typically 11-12. For 2 to less than 5% trade NaOCl, the pH is typically 10-11.

EXAMPLES

Example 1

Sodium Hypochlorite System with 1500 Gallon/Day Production Capacity

A 1500 lb/day equivalent chlorine system was designed and constructed with a capacity to supply 1500 gallons per day of 12.5% "trade" sodium hypochlorite (125 gm/L as NaOCl) for a water treatment plant. The electrolyzer module consisted of six membrane cell electrolyzers having five cells per electrolyzer and isolation valves on each electrolyzer inlet and outlet lines for isolation control. The electrolyzers were prepared utilizing DuPont Nafion brand N324 cation ion exchange membranes, anodes with an EC-521 anode coating on titanium substrate from Eltech Systems Corporation (Chardon, Ohio), and ASTM grade 316 stainless steel electrodes as cathodes.

The system was designed with the brine treatment system containing two Bayer A.G. trademark brand Lewatit TP208 chelating ion exchange resin columns having a recirculating flow through each column of 6 GPM producing a softened brine having a consistent total hardness content of less than 20 ppb as measured using a HACH Company (Loveland, Colo.) HNB (Hydroxy Napthol Blue) calorimetric kit method detailed in their 3$^{rd}$ edition Handbook of Brine Analysis. The saturated brine flow stream through the columns was operated at a temperature of 60° C. and the brine was adjusted to a pH of about 9.90 with NaOH addition.

The purified softened saturated brine feed to the electrolyzers was rate flow controlled by the operating amperage rate, and a Burkert model 8226 toroidal conductivity sensor/transmitter was placed in the depleted brine stream to monitor the brine conductivity. Additional brine was added to the electrolyzer anolyte loop via a solenoid valve, allowing more brine addition. The operating setpoint of the conductivity control was 190 mS, controlling the depleted brine at a concentration of about 210 gm/L. The brine control tracked the operation of the system from 10% to 100% of the system maximum operating rate.

The electrolyzers, operating at the full 1500 gal/day sodium hypochlorite rate, operated at a current of 850 amps with electrolyzer voltages of about 21-22 volts. The hydrogen produced from the electrolyzers was diluted using a 350 CFM blower that passed air through the headspace of the caustic header tank and was safely vented to the atmosphere.

The depleted brine was stripped of chlorine by HCl addition to a pH of 2 and with air stripping and then passed into a depleted brine tank for final pH adjustment to a pH of 10 with NaOH and dechlorinated completion with the addition of 38% sodium bisulfite. The bisulfite addition was controlled using a GF Fisher Signet model 2715 ORP sensor (Pt versus Ag/AgCl reference), which controlled the addition of the bisulfite to achieve a 60-80 mV control setpoint. The dechlorinated pH 10 depleted brine solution contained no chlorine and had an excess residual sulfite of about 30-60 ppm. The brine solution was then passed into the briner tank for resaturation with NaCl.

The chlorine gas and approximately 15 wt % NaOH that were produced from the electrolyzer module and chlorine from the brine dechlorination were reacted together in the sodium hypochlorite conversion module to produce 125 gm/L sodium hypochlorite, equivalent to 12.5 trade % sodium hypochlorite. The sodium hypochlorite recirculation pump with eductor provided the vacuum for extracting the chlorine from the electrolyzer module. Two pairs of silver and platinum ORP probes (Powell Fabrication and Manufacturing, Inc., St. Louis, Mich., Model 915-02360/02367) were used to monitor and control the addition of 15% NaOH into the sodium hypochlorite tank to maintain a residual NaOH in the 0.2-0.5 wt % range equating to pH range between 11.5 and 13, for sodium hypochlorite product stability. The sodium hypochlorite ORP control was operated in a range of 520 to 600 mV. The amount of residual NaOH in the sodium hypochlorite was inversely proportional to the ORP. The ORP control also allowed for producing lower residual NaOH in the sodium hypochlorite for potable water treatment plants specifying minimal amounts of excess residual NaOH or alkalinity in their water product stream. The sodium hypochlorite product concentration ranged from 12.5 to 13.5% trade NaOCl.

Example 2

Chlorine System with 750 lb/Day Production Capacity

A similar chlorine system as in Example 1 was constructed as a demonstration for a potable water treatment plant requiring chlorine gas as the treatment chemical. The system consisted of only four (4) electrolyzers with five (5) cells per electrolyzer with a capacity of 750 lbs/day of elemental chlorine gas. The same brine softening module and sodium hypochlorite conversion module was used. The only chlorine distributed to the sodium hypochlorite conversion unit was the amount that was stripped from the depleted brine.

The system produced elemental chlorine gas, which was educted into one of the solution streams at the potable water treatment plant at a variable rate to achieve and maintain chlorine residual level of 0.75 to 1 ppm chlorine. The actual chlorine production rate was manually adjusted at this installation site by changing the rectifier DC current to the electrolyzers, which was determined to be proportional to the chlorine production rate of the electrolyzers. Since the chlorine was extracted as the final product from the anolyte system, the excess sodium hydroxide being produced at 15% concentration was separately decanted since it was not being reacted with the chlorine. The subject water treatment plant used the excess sodium hydroxide solution for solution pH control in another area of the facility. Operating at a chlorine production rate of 750 lb/day, the sodium hypochlorite co-product produced from the system was about 25 gallons per day with a 12% trade NaOCl concentration.

While the disclosure has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed:

1. An electrochemical generating system for producing chlorine gas, sodium hydroxide, and sodium hypochlorite solution, comprising:

a. a brine module comprising: at least one briner tank, in which solid sodium chloride (having hardness content of less than 50 ppm as Ca) and softened water can be contacted to form a saturated aqueous solution of sodium chloride (saturated brine); and an outlet for saturated brine which is in fluid communication with the briner tank;

b. a brine softener module comprising: a brine recirculation tank, an inlet for saturated brine, an outlet for softened brine, a sodium hydroxide (NaOH) source, a pH sensor and at least one chelating ion exchange resin bed; said brine module being in fluid communication with said brine softener module; and said brine recirculation tank, said inlet for saturated brine, said outlet for softened brine, said NaOH source, said pH sensor and said at least one chelating ion exchange resin bed being in fluid communication with each other;

wherein the saturated brine is circulated through at least one chelating ion exchange resin bed and the brine recirculation tank to form softened brine;

c. an electrolyzer module comprising: an anolyte tank, a conductivity sensor, a chlorine head tank, an NaOH head tank, an NaOH receiver tank, and a plurality of electrolyzers, wherein:

(i.) each electrolyzer is a membrane cell electrolyzer, comprising: an anolyte compartment, said anolyte compartment capable of oxidizing a softened brine mixture comprising softened brine and depleted brine, and having an inlet for the softened brine mixture and an outlet for chlorine gas/depleted brine; a catholyte compartment having an inlet for aqueous NaOH and an outlet for hydrogen gas/NaOH solution; and a cation ion exchange membrane which is interposed between said anolyte compartment and said catholyte compartment and which is in fluid communication therewith; wherein sodium ions can pass through the cation ion exchange membrane from the anolyte compartment to the catholyte compartment; and wherein said plurality of electrolyzers, conductivity sensor, and anolyte tank are in fluid communication with each other;

wherein softened brine is capable of being added to depleted brine to provide the softened brine mixture at a selected concentration, and wherein said selected concentration of the softened brine mixture is maintained by controlling an addition of softened brine to the depleted brine with the conductivity sensor;

(ii.) the chlorine head tank comprises: a chlorine tank header having an inlet for chlorine gas/depleted brine, an outlet for depleted brine, a chlorine gas takeoff and, optionally, a second chlorine gas takeoff; said header being in chlorine/depleted brine fluid communication with the plurality of electrolyzers, in depleted brine fluid communication with the anolyte tank and, optionally, in chlorine fluid communication with a second chlorine takeoff;

in which the chlorine gas formed in the anolyte compartments is separated from the chlorine gas/depleted brine that exits the plurality of electrolyzers to form a chlorine gas stream and a depleted brine stream; and (iii.) the NaOH head tank for separating hydrogen gas from a hydrogen gas/NaOH solution comprises: a NaOH tank header having an inlet for the hydrogen gas/NaOH solution, an air diluted hydrogen gas outlet, a concentrated NaOH solution outlet, an overflow concentrated NaOH solution outlet, and an air inlet comprising a blower, said NaOH tank header being in fluid communication with:

the electrolyzers through the hydrogen gas/NaOH solution inlet and through the first concentrated NaOH solution outlet in which the concentrated NaOH solution outlet fluid communication also contains an inlet for water for diluting said first concentrated NaOH solution, the NaOH receiver tank through the overflow concentrated NaOH solution outlet, and the air inlet;

in which air disengages hydrogen gas from the hydrogen gas/NaOH solution to form a hydrogen/air stream, a concentrated NaOH solution stream and an overflow concentrated NaOH solution stream;

said hydrogen gas in said hydrogen/air stream being diluted to below its lower explosive limit (LEL) in air; and d. a NaOCl conversion module comprising: a conversion tank, an ORP sensor, an NaOH solution inlet, a chlorine gas inlet, a trade NaOCl solution outlet, and a water inlet, said conversion tank comprising:

a tank for generating the NaOCl solution and containing therein a solution comprising NaOH, and a circulation loop for circulating at least a portion of the conversion tank mixture, said circulation loop comprising first, second, and third sub-loops, wherein:

said first sub-loop is in fluid communication with an eductor for drawing chlorine from the chlorine head tank into the conversion tank mixture circulating through the eductor, wherein said eductor is in fluid communication with the chlorine head tank;

said second sub-loop is in fluid communication with a chlorine absorption tower; and said third sub-loop is in fluid communication with a heat exchanger for cooling the conversion tank mixture passing through said heat exchanger;

said NaOCl conversion module being in chlorine fluid communication with the chlorine tank header;

said conversion tank being in fluid communication with the NaOH receiver tank, the chlorine head tank, and a water source;

said conversion tank, said ORP sensor, said NaOH solution inlet, said trade NaOCl solution outlet, and said water inlet being in fluid communication with each other, and said chlorine gas inlet being in fluid communication with said NaOCl conversion module, in which the chlorine gas can be contacted with a NaOH solution in the conversion tank to form a 2-15% trade NaOCl solution, the ORP sensor is capable of monitoring the NaOH level of the output from the tank, and the water inlet allows for an adjustment of the concentration of NaOCl solution formed; and wherein from 1-100% of the chlorine gas generated in the electrochemical generating system can be converted to trade NaOCl solution.

2. The electrochemical generating system of claim 1, wherein the brine module further comprises a recycled depleted brine inlet and a depleted brine tank, said depleted brine tank comprising: an inlet for depleted brine, an inlet for addition of base to control the pH of the depleted brine, a pH sensor capable of controlling the addition of base to the depleted brine tank, an inlet for addition of $NaHSO_3$, an ORP sensor capable of controlling the addition of $NaHSO_3$ to the depleted brine tank, and an outlet for transferring depleted brine to the brine module; said depleted brine tank, inlet for depleted brine, inlet for addition of base, pH sensor capable of controlling the addition of base, inlet for addition of $NaHSO_3$, ORP sensor capable of controlling the addition of $NaHSO_3$, outlet for transferring depleted brine, briner tank, and anolyte tank, all being in fluid communication with each other.

3. The electrochemical generating system of claim 1, having a plurality of chelating ion exchange resin beds connected in parallel in the brine softener module.

4. The electrochemical generating system of claim 1, wherein the brine softener module further comprises a brine heater in fluid communication with the brine softener module.

5. The electrochemical generating system of claim 1, wherein the electrolyzer module anolyte tank further comprises a heat exchanger for cooling an analyte tank solution comprising the depleted brine stream, wherein said heat exchanger is in fluid communication with said anolyte tank.

6. The electrochemical generating system of claim 1, wherein the electrolyzer module is capable of producing a 2 volume % or less hydrogen in air stream.

7. The electrochemical generating system of claim 1, wherein the sodium hypochlorite conversion module further comprises a chlorine stripping tank and a depleted brine tank, wherein:

a. the chlorine stripping tank comprises: a stripping tank, an inlet for depleted brine from the anolyte tank, an outlet to the depleted brine tank, an inlet for addition of acid to control the pH of the depleted brine, a pH sensor capable of controlling the addition of acid to the chlorine stripping tank, a chlorine stripping column, an air source for removing chlorine from the chlorine stripping column, and a chlorine outlet being in fluid communication with the chlorine stripping column;

said chlorine stripping tank, inlet for depleted brine, inlet for addition of acid, pH sensor, air source for removing chlorine and providing a chlorine-stripped depleted brine in the chlorine stripping tank, outlet chlorine-stripped depleted brine, and chlorine stripping column, are all in fluid communication with each other;

said chlorine outlet is in fluid communication with the NaOCl conversion tank; and said chlorine stripping tank is in fluid communication with the anolyte tank; and b. the depleted brine tank comprises an inlet for the chlorine-stripped depleted brine, an inlet for addition of base to control the pH of the depleted brine, a pH sensor capable of controlling the addition of base to the depleted brine tank, an inlet for addition of $NaHSO_3$, an ORP sensor capable of controlling the addition of $NaHSO_3$ to the depleted brine tank, and an outlet for transferring depleted brine to the brine module;

wherein said depleted brine tank, inlet for the chlorine-stripped depleted brine, inlet for addition of base, pH sensor capable of controlling the addition of base, inlet for addition of $NaHSO_3$, ORP sensor capable of controlling the addition of $NaHSO_3$, and outlet for transferring depleted brine are all in fluid communication with each other, and said depleted brine tank is in fluid communication with the briner tank.

8. The electrochemical generating system of claim 1, further comprising a water softening module in fluid communication with the electrochemical generating system.

9. The electrochemical generating system of claim 1, further comprising a NaOH solution unit in fluid communication with the NaOH receiver tank and capable of mixing softened water and a high strength NaOH solution to form a NaOH solution.

10. The electrochemical generating system of claim 1, further comprising an emergency shutdown chlorine collection system, wherein the emergency shutdown chlorine collection system comprises a water source and an eductor, each being in fluid communication with the chlorine head tank.

11. The electrochemical generating system of claim 1, wherein the chlorine head tank further comprises a second chlorine gas takeoff, said second chlorine gas takeoff having one or more additional application points, said second chlorine gas takeoff and said one or more additional application points all being in fluid communication with the chlorine head tank.

12. The electrochemical generating system of claim 2, wherein said depleted brine tank comprises: an inlet for depleted brine, an inlet for addition of sodium hydroxide to control the pH of the depleted brine, a pH sensor capable of controlling the addition of sodium hydroxide to the depleted brine tank, an inlet for addition of $NaHSO_3$, an ORP sensor capable of controlling the addition of $NaHSO_3$ to the depleted brine tank, and an outlet for transferring depleted brine to the brine module; said depleted brine tank, inlet for depleted brine, inlet for addition of sodium hydroxide, pH sensor capable of controlling the addition of sodium hydroxide, inlet for addition of $NaHSO_3$, ORP sensor capable of controlling the addition of $NaHSO_3$, outlet for transferring depleted brine, briner tank, and anolyte tank, all being in fluid communication with each other.

* * * * *